US006789522B2

(12) United States Patent
Seymour

(10) Patent No.: US 6,789,522 B2
(45) Date of Patent: Sep. 14, 2004

(54) ENGINE FOR AERONAUTICAL APPLICATIONS

(76) Inventor: John Seymour, 16130 Daphne Ave., Torrance, CA (US) 90504

( * ) Notice: Subject to any disclaimer, the term of this patent is extended or adjusted under 35 U.S.C. 154(b) by 81 days.

(21) Appl. No.: 10/201,814

(22) Filed: Jul. 23, 2002

(65) Prior Publication Data

US 2003/0015166 A1 Jan. 23, 2003

Related U.S. Application Data

(60) Provisional application No. 60/307,563, filed on Jul. 23, 2001.

(51) Int. Cl.[7] ..... F02B 77/00

(52) U.S. Cl. ..... 123/198 R; 123/192.2; 74/574

(58) Field of Search ..... 123/198 R, 192.2, 123/54.4, 195 C, 196 R, 192.1; 60/904; 244/53 R; 74/574

(56) References Cited

U.S. PATENT DOCUMENTS 3,861,828 A * 1/1975 Biermann et al. ..... 416/145
4,973,221 A * 11/1990 Anderson et al. ..... 415/119
5,074,812 A * 12/1991 Watanabe ..... 440/52
6,612,279 B2 * 9/2003 Asahara ..... 123/192.1

* cited by examiner

*Primary Examiner*—Tony M. Argenbright
*Assistant Examiner*—Katrina B. Harris
(74) *Attorney, Agent, or Firm*—Adam H. Jacobs

(57) ABSTRACT

The present invention provides an improved engine for aeronautical applications which includes a core engine block having a drive shaft rotatably mounted within the core engine block and a motive device for rotating the drive shaft. A propeller speed reduction unit is connected to the drive shaft for transferring power from the drive shaft to a propeller and an accessory drive gearbox is connected to the drive shaft for transferring power from the drive shaft to at least one accessory device. The accessory drive gearbox includes an accessory drive crank gear connected to the drive shaft and a drive gear intermeshing with the crank gear. Finally, at least two inter-module dampers are mounted in the engine, one each of the inter-module dampers positioned between the core engine block and the accessory drive gearbox and the core engine block and the propeller speed reduction unit to dampen and isolate vibrations.

7 Claims, 6 Drawing Sheets

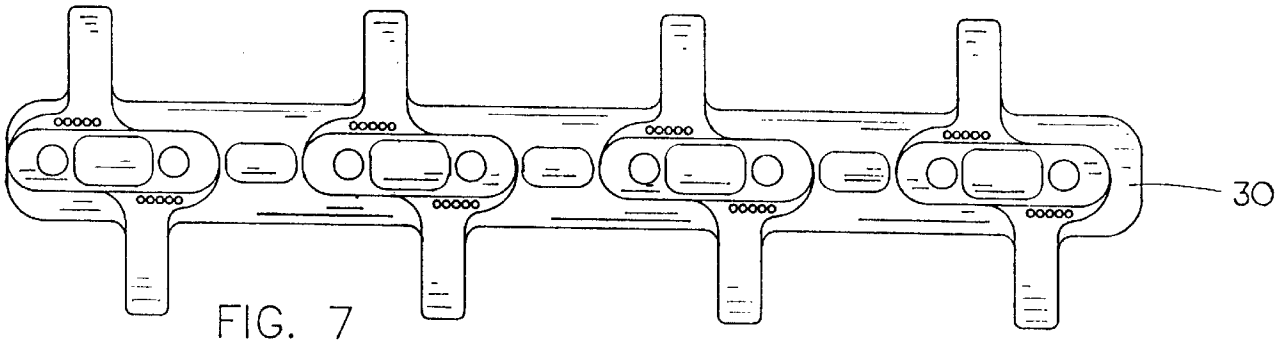
FIG. 7
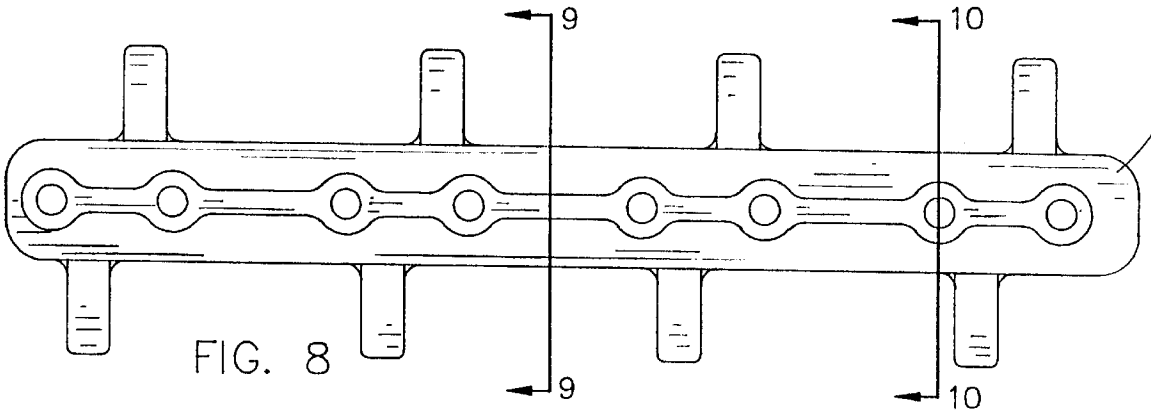
FIG. 8
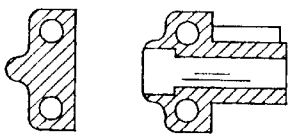
FIG. 9
FIG. 10
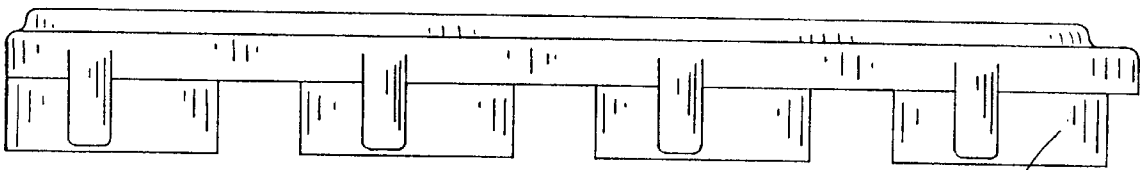
FIG. 11
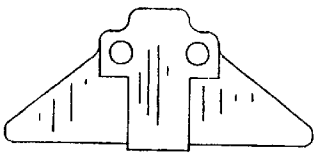
FIG. 12

ENGINE FOR AERONAUTICAL APPLICATIONS

CROSS-REFERENCE TO RELATED PROVISIONAL PATENT

This application claims priority based on a provisional patent, specifically on the Provisional Patent Application Serial No. 60/307,563 filed Jul. 23, 2001.

BACKGROUND OF THE INVENTION

1. Technical Field

The present invention relates to engines and, more particularly, to an improved engine for aeronautical applications which includes a core power plant and two modules connected thereto, and four modules if supercharged, a propeller speed reduction unit and an accessory drive gearbox, and if supercharged a step-up gearbox to drive the blower and also a damper between the engine crank shaft and the step-up or overdriven gearbox which couples to the blower as a unit, a fluid-type vibration damping unit interposed between the accessory drive gearbox and the core power plant, a urethane compound damper interposed between the propeller speed reduction unit and the core power plant, and other unique features acting in concert to significantly improve performance and longevity.

2. Description of the Prior Art

Aircraft engines are subjected to extreme conditions yet must function without fail in order to prevent catastrophic loss of life. This is especially true in the case of single-engine aircraft which have no backup engine power should the engine fail. It is also necessary to provide large amounts of thrust from the engine and propeller unit in order to both permit controlled flight and sufficient speed for the aircraft to get where it is going in a reasonable amount of time. To solve these problems, recent aircraft have utilized turboprop or turbojet engines which have a relatively high thrust-to-weight ratio and are generally reliable. However, such engines have inherent deficiencies, particularly in terms of cost and fuel consumption. There is therefore a need for an aircraft engine which is not of the turboprop or turbojet design to avoid the deficiencies of those designs yet has the beneficial features of the designs.

An engine which fits these needs is the traditional internal combustion engine having a plurality of pistons and cylinders which provide the driving force for the drive shaft. However, in terms of thrust-to-weight ratio, piston engines have heretofore been at the lower end of the spectrum and thus are usable for only certain aeronautical applications. There is therefore a need for an piston-driven aircraft engine which is usable in a greater number of situations and can substitute for and even replace other types of aircraft engines currently being used.

Another problem encountered with propeller driven aircraft is that when they take off or turn in flight, their propeller shaft is placed under extremely high loads. Forces from these loads are partly absorbed by the propeller shaft and partly transferred to thrust and rotational bearings which support the propeller shaft. However, some of these forces are undesirably transferred to the gear train connecting the propeller shaft to the crankshaft, the crankshaft itself, and other engine parts, e.g., connecting rods, pistons, and crankshaft bearings and seals. Many of these components are not designed to accommodate such forces. Consequently, the effective life of these components is reduced and the servicing and replacement of these components must be done more frequently. Further, the failure of one of these components in flight or during take off may cause the plane to crash, possibly resulting in human injuries and deaths and significant property damage. There is therefore a need for a propeller speed reduction unit which will substantially eliminate many of the above-described problems.

Another issue which occurs with aircraft is the design and operation of the secondary power system. Secondary power systems of the type used in single engine aircraft present significant and unique challenges to designers. Such power systems are typically required to provide a highly reliable and virtually uninterrupted source of power to flight or mission critical accessories or subsystems on the aircraft despite exposure to extremes in temperature and altitude.

In the jargon of aircraft power systems, the term "Primary Power System" is generally meant to include only the primary propulsion engine, and the term "Secondary Power System" is sometimes used in a broad sense to include all power consuming accessories, gearboxes, accessory drives, and power sources on the aircraft other than the propulsion engine. The term "Secondary Power System" is used herein in a somewhat narrower context intended to include only those accessories, gearboxes, accessory drives, and secondary power sources receiving rotating shaft power from the propulsion engine.

Virtually all large aircraft secondary power systems include some form of engine gearbox operably connected to receive rotating shaft power from the propulsion engine, and most are configured to provide multiple mechanical drive shafts for connection to the accessories. Engine gearboxes also typically include gear trains to convert engine RPM into the proper speed for the accessories driven by those drive shafts, with typical accessories including an electrical generator, hydraulic pumps, an air turbine starter for the propulsion engine, and engine driven fuel pumps. Such engine gearboxes tend to rob power from the propulsion engine, however, and thus they are not generally used with piston-driven engines due to the limited power output from the engine. As such engine gearboxes are generally preferred, however, there is a need for an engine accessory drive for use with piston-driven engines which utilizes such an engine gearbox.

Therefore, an object of the present invention is to provide an improved engine for aeronautical applications.

Another object of the present invention is to provide an improved engine for aeronautical applications which includes a core power plant, an accessory drive gearbox, a propeller speed reduction unit and a "spider" unit which controls oil distribution.

Another object of the present invention is to provide an improved engine for aeronautical applications which includes a propeller speed reduction unit for translating the drive shaft output to the propeller in an efficient and reliable manner.

Another object of the present invention is to provide an improved engine for aeronautical applications which provides a greater power output than other engines of its size.

Another object of the present invention is to provide an improved engine for aeronautical applications which includes an oil delivery system which has an air/oil centrifugal separator to separate and remove air bubbles from the oil.

Finally, an object of the present invention is to provide an improved engine for aeronautical applications which is efficient in design and which is safe and durable in use.

SUMMARY OF THE INVENTION

The present invention provides an improved engine for aeronautical applications which includes a core engine block having a block valley and having a drive shaft rotatably mounted within the core engine block and a motive device for rotating the drive shaft, the motive device including two cylinder banks in a V-type configuration. A propeller speed reduction unit is connected to the drive shaft for transferring power from the drive shaft to a propeller mounted on the propeller speed reduction unit and an accessory drive gearbox is connected to the drive shaft for transferring power from the drive shaft to at least one accessory device connected to the accessory drive gearbox. The accessory drive gearbox includes an accessory drive crank gear connected to the drive shaft and a drive gear intermeshing with the crank gear for translating rotation of the crank gear to at least one accessory drive gear intermeshed therewith. At least two inter-module dampers are mounted in the engine, at least one of the inter-module dampers positioned between the core engine block and the accessory drive gearbox and at least one of the inter-module dampers positioned between the core engine block and the propeller speed reduction unit, each of the at least two inter-module dampers operative to dampen and isolate vibrations preventing destructive resonances from initiating. Finally, at least two coolant pumps are connected in fluid transmission connection to the core engine block, the at least two coolant pumps operative to circulate coolant fluid within the core engine block for cooling thereof, the at least two coolant pumps connected in redundant fluid connection whereby individual cylinder banks are cooled by a specific one of the at least two coolant pumps and, in the event of failure of one of the at least two coolant pumps, the remaining pump via a system of bypass and check valves, together with cross-feed lines, ensures continued coolant liquid flow from the remaining pumps to core engine block.

The improved engine of the present invention is specifically designed to solve the problems found in the aviation field. Specifically, the present invention provides an engine which has a relatively high thrust-to-weight ratio and is generally reliable while simultaneously being relatively inexpensive and miserly in fuel consumption. Furthermore, as the present invention provides both an accessory drive gearbox and a propeller speed reduction unit which are durable in construction and offer extended working lifetimes, repair costs are kept low while still supplying the needed functional characteristics of a desirable aircraft engine. Finally, the present invention provides a piston-driven aircraft engine which is powerful yet reliable and light-weight, a difficult feat to accomplish in the piston-driven engine field. The present invention thus provides a substantial improvement over those devices found in the prior art.

BRIEF DESCRIPTION OF THE DRAWINGS

FIGS. 7–12 are various views of the "spider" of the present invention.

DESCRIPTION OF THE PREFERRED EMBODIMENT

The present invention is a new engine designed for use in small to medium sized aircraft, but one which is useful in virtually any application where a small engine producing maximum horsepower is needed.

Figure 1:
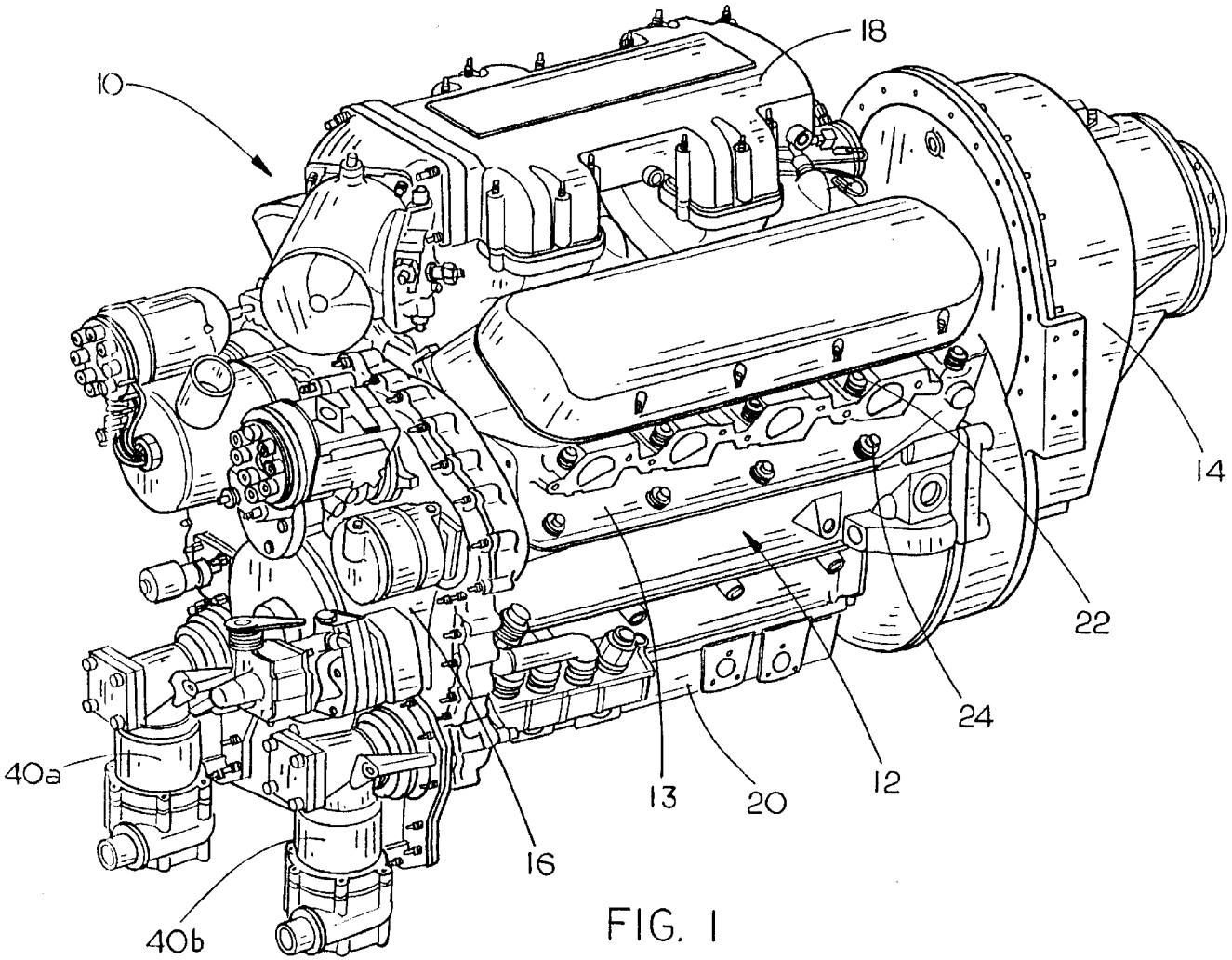
FIG. 1 is a perspective view of the engine of the present invention.

FIG. 1 shows the engine 10 of the present invention as including a core engine 12 consisting of a core engine block 13 and three main power plant modules: the propeller speed reduction unit 14, the accessory drive gearbox 16 and the optional but preferred supercharger assembly 18. In the preferred embodiment, the core engine block is either a 60 or 90-degree V-6, V-8, V-12 or V-16 liquid-cooled engine. In view of the intended application to aircraft, the major design goals are to maximize safety, reliability and longevity, goals which are met by the present invention.

The important features of the core engine are listed herein in no particular order, but it is believed that each of the listed features adds to the overall performance and efficiency of the present invention.

- The engine oil pan 20, core engine block 13 and accessory drive gearbox 16 are interconnected in a manner that stiffens and strengthens the rear sections of the engine 10.
- After the engine is started, an electrical system (alternator, generator, battery, etc,) is not required to sustain continued operation. This is a major safety feature for aviation applications. Likewise, to enhance safety and reliability, redundant systems are employed for engine lubrication, cooling, and ignition.
- A direct-type mechanical fuel injection system is employed.
- To maximize safety, reliability and longevity, neither flexible belts nor chains are employed anywhere in the entire power plant.
- Engine Bore and Stroke in the preferred embodiment: 4.5-inch bore×4.5-inch stroke, 573 cubic inches swept volume, block cast from 356-T6 aluminum alloy with a 10.200 inch deck height, although, of course, both larger and smaller dimensions for the described elements will work equally well with the present invention.
- Furthermore, in the preferred embodiment, each cylinder mounts two spark plugs. The forward plug 22 is sparked by one independent ignition system and the aft plug 24 is sparked by the other. The engine is contemplated to have either two or more valves and either pushrod activated valve train or overhead cam valve activation. The engine of the present invention will also preferably have combustion chamber configurations of wedge, hemi or any modification thereof. The engine can operate normally following the failure of a single ignition system. It is also contemplated that the cylinder heads/banks could be of two or more piece construction with the sections secured to one another by bolts or the like. To ensure no leakage from the cylinder heads/banks, it is preferred that the sections include a set of "o"-rings therebetween which are clamped by the head studs or bolts.
- A unique "spider" device is fitted to the block valley. The spider 30, as shown best in FIGS. 7–12, is a pipe network which, in the preferred embodiment, performs most, if not all, of the following functions:
  - Vents the block valley to the crankcase;
  - Prevents oil drain-back onto the reciprocating assembly and thereby greatly reduces oil aeration, thus enhancing cooling and therefore reliability and longevity;

Routes oil pressure feed to the front of the block oil gallery and provides oil scavenging of the intake valley;

Strengthens and stiffens the engine block;

Fixtures the valve lifter guides; and

Allows elimination of linked lifters, thereby enhancing reliability. In the future this device will be of two or more pieces and assembled and sealed with an "o"-rings and clamped by the hollow valley bolts.

Figure 4:
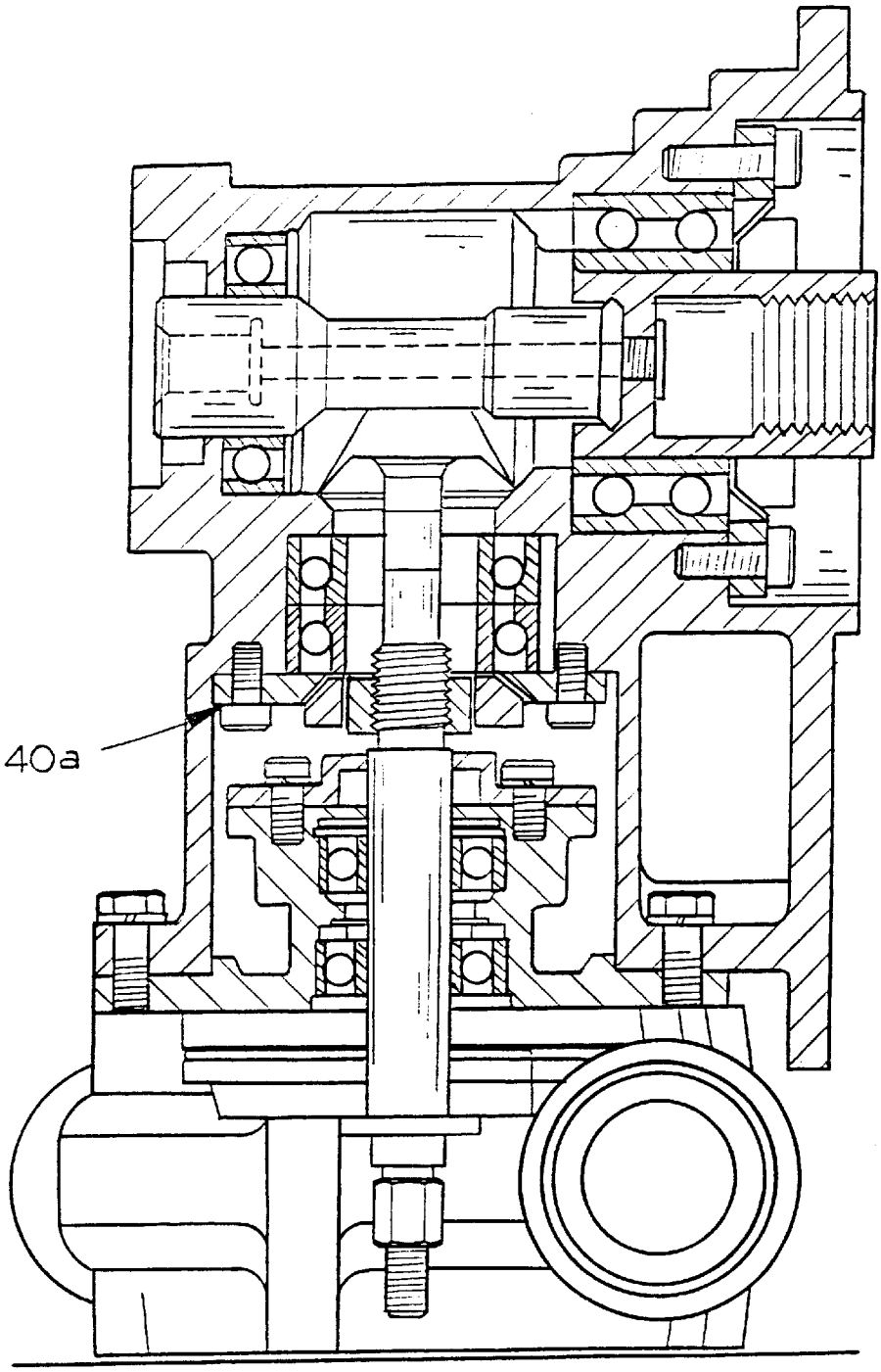
FIG. 4 is a detail side elevational view of a water pump of the present invention.
Figure 5:
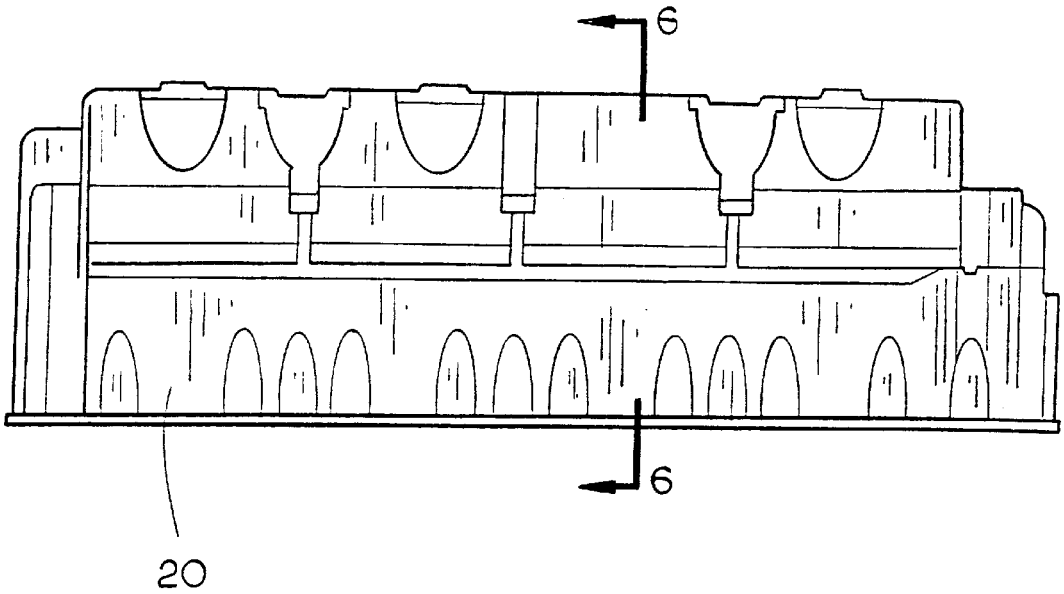
FIG. 5 is a side elevational view of the oil pan of the present invention.
Figure 6:
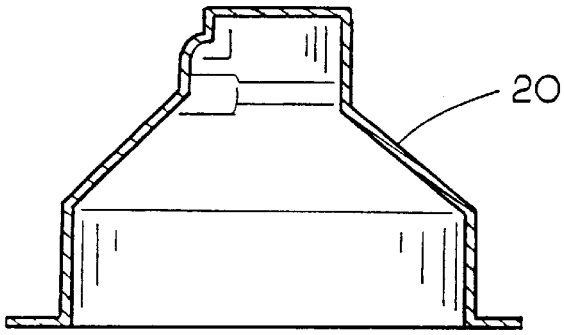
FIG. 6 is a front elevational view of the oil pan of the present invention.

Two coolant (glycol) pumps 40*a* and 40*b* are provided as shown best in FIGS. 1 and 4. Individual cylinder banks are cooled by a specific pump. Should one pump fail, the remaining pump carries the engine coolant load. A system of bypass and check valves, together with cross-feed lines, ensures that both heads receive coolant flow from the remaining pump.

Pistons are cooled by individual continuous spray oil-jets, the oil jets positioned to spray onto the undersides of the pistons and onto the piston rods with the oil jet nozzles being mounted in the pan such that they are readily removable for servicing. Removal of the oil jet nozzles facilitates in-situ inspection of the connecting rods, lower cylinder bore and undersides of the pistons, thereby greatly lessening the work needed to view the internal workings of the engine, a boon for mechanics.

In the preferred embodiment, the crankshaft is machined from a billet of 280,000 psi steel alloy and is gun-drilled for lightness, the crankshaft also being cross-drilled for oil feed passages, nitride-hardened to a depth of 0.010"–0.015" and being polished in the direction of rotation.

The block and pan rails are spread to permit large strokes and extra head bolts are fitted to the block valley to provide optimum head gasket sealing.

The connecting rods are of either the I-beam or of the H-beam type with shoulders shaped so as to obviate the necessity of grooving the block to permit the long stroke of the crank and to allow rod to cam clearance also they embody an oil hole through the beam to lubricate and cool the piston pin.

The accessory drive crank gear and the supercharger drive adapter are both driven from the end of the crankshaft.

The bearing size and configuration substantially increases the strength and stiffness of the rotating/reciprocating assembly.

The spark plug firing order is non-standard. It has been optimized for smooth running, and the ignition wiring harness employs threaded spark plug leads that retain the leads in place under high vibration and acceleration loads and low radio interference.

One of the important features of the present invention involves the use of inter-module dampers positioned between each of the power plant modules. Each damper operates to dampen and isolate vibrations, thereby preventing destructive resonances from initiating. In the preferred embodiment, the dampers between the propeller speed reduction unit and the core power plant are constructed of a high-impact, high-density urethane compound, specifically consisting of a series of urethane "biscuits" which operate to absorb vibrations. The damper 42 between the accessory drive gearbox and the main power plant is shown best in FIG. 2 as being a generally toroidal fluid-type harmonic vibration damper which runs inside the accessory case. It serves to isolate the vibrations of the engine reciprocating assembly and the accessory drive from each other thus permitting smoother rotation of the gears in the accessory drive gearbox 16 and thus reducing wear and tear on the gears.

Figure 2:
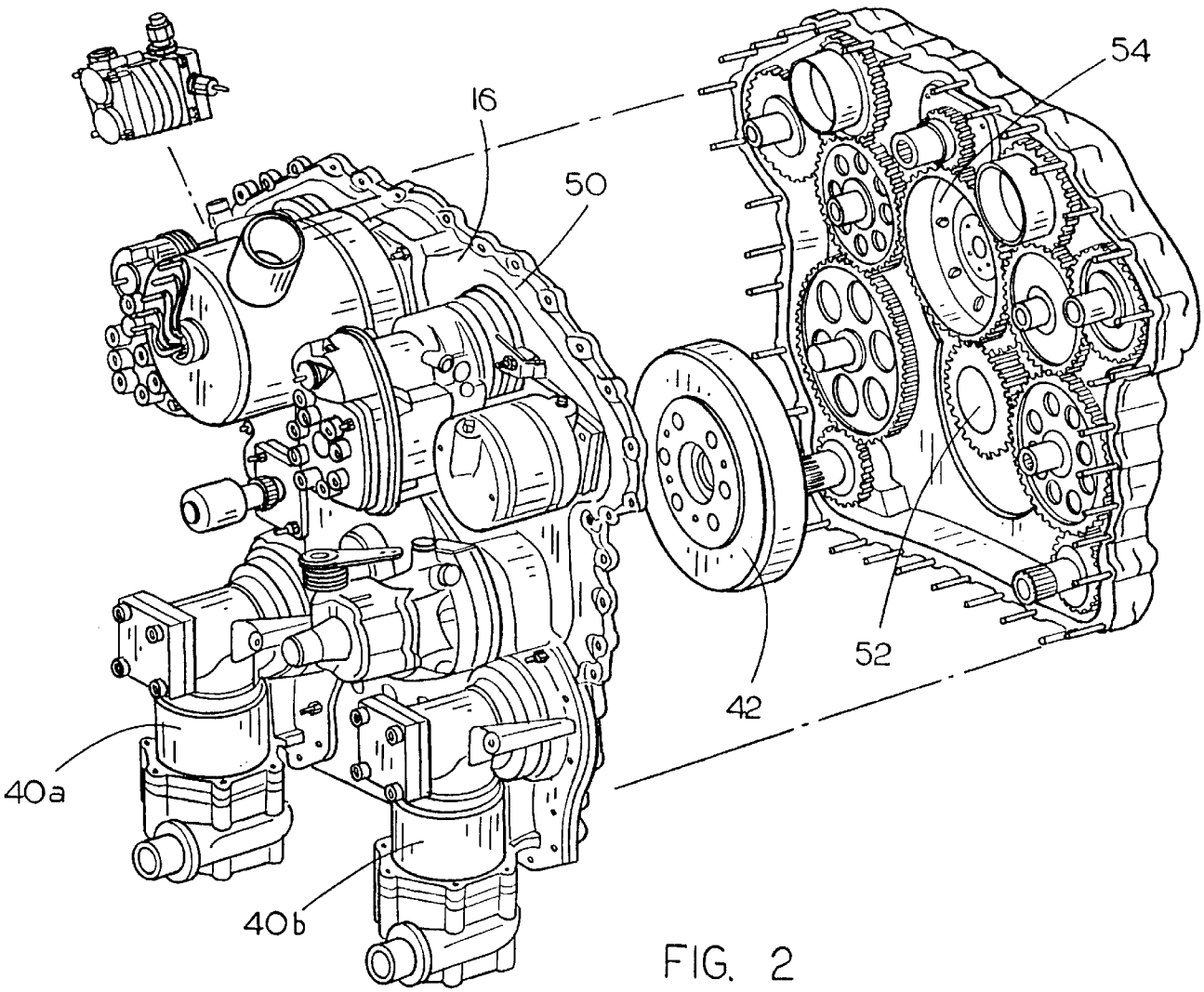
FIG. 2 is a perspective view of the accessory drive gearbox of the present invention.
Figure 3:
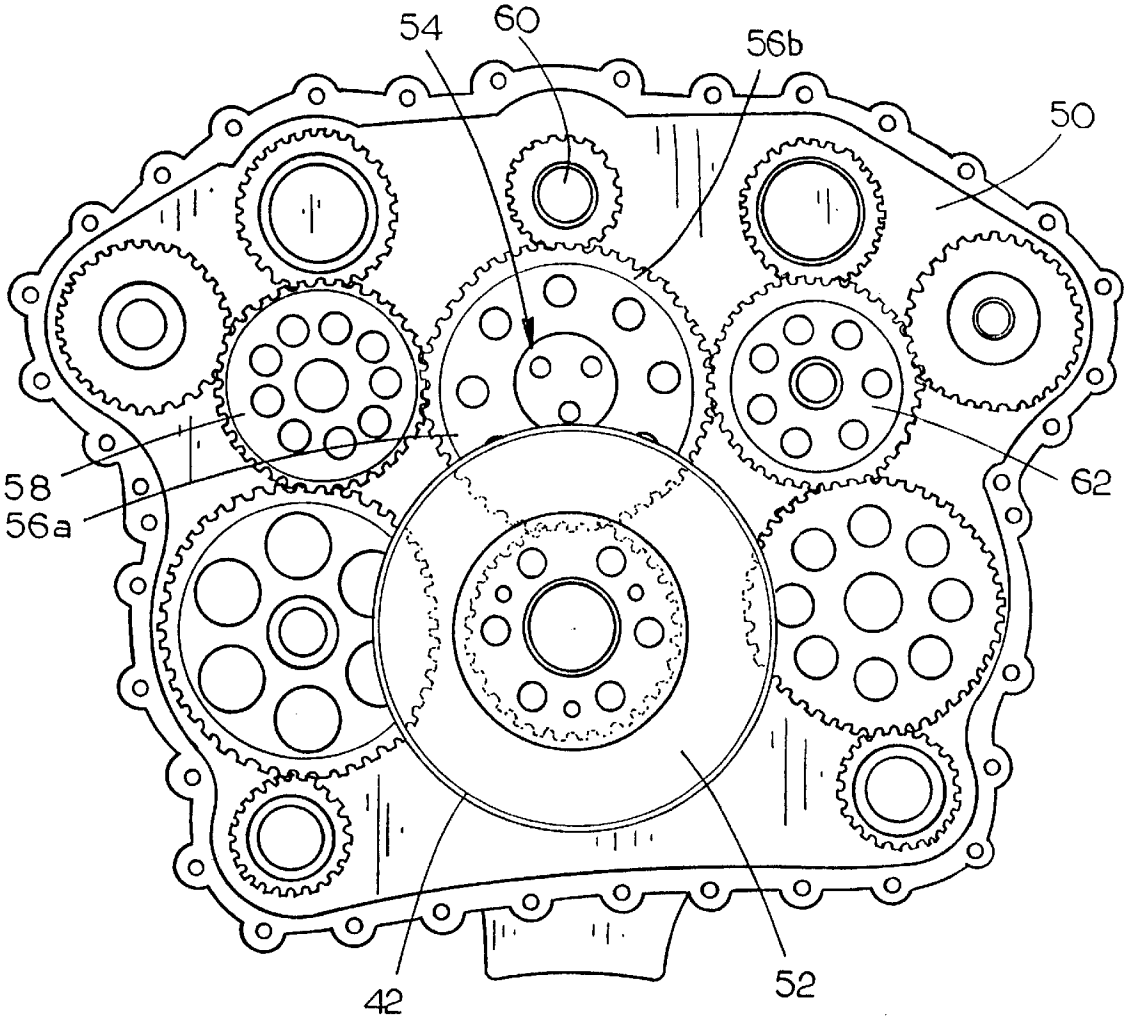
FIG. 3 is a detail front elevational view of the accessory drive gearbox of the present invention.

The important features of the accessory drive gearbox 16 as shown best in FIGS. 2 and 3 are listed herein in no particular order, but it is believed that each of the listed features adds to the overall performance and efficiency of the gearbox of the present invention.

In the preferred embodiment, the accessory drive gearbox case 50 is made from 2024 aluminum in billet form and from 356-T6 in cast form and spur-type gears are featured.

All gears are oiled as they exit mesh via oil spray jets. This lubricates as well as cools the gear tray.

The accessory drive crank gear 52 is a 9-pitch, 20-degree pressure angle design. This gear meshes with the 9-pitch, 20-degree pressure angle, compound-cam drive gear 54.

The compound-cam drive gear 54 comprises two gear wheels 56*a* and 56*b* on a common shaft. The driven gear 56*a* is a 9-pitch, 20-degree pressure angle gear that is driven by the crank gear 52. In the future it is contemplated that a damper will be installed between the two gears 56*a* and 56*b* that comprise the two gears of the compound gear to isolate value train harmonics from the accessory drive gear train and its complement of components. The second driving gear wheel 56*b* of the pair in turn drives the 10-pitch, 25-degree pressure angle gear. This gear drives all the other gears on the accessory drive. In the preferred embodiment, all of these gears are 10-pitch gears.

The driving gear wheel 56*b* of compound-cam drive gear 54 has three mating gears 58, 60 and 62, one of which is the alternator drive gear. It is contemplated that in the future a viscous drive (torque converter) will be added between the alternator gear and the alternator to lower the shock on the alternator when the engine is started. The viscous drive will likely further include an electrically operated lockout clutch to avoid the problem of heating the oil in the viscous drive when the engine is operational and it would automatically disengage when the power lever is pulled to eliminate shock on the alternator drive due to the fact it is over driven 1.6×. Also, the lockout clutch would give it an increased level of efficiency. The crankshaft speed is stepped up by approximately 1.6× and the other two gears are idler gears that mesh with another three gears. One is the magneto drive gear and the vacuum/hydraulic gear. A splined shaft is provided so that any chosen pump can be driven.

The other engaging gear is the tachometer drive gear on the left side of the gearbox and the propeller governor drive on the right. These gears have one engaging gear that is the water pump/oil pump gear.

The axle sleeves ride on needle roller bearings. This configuration is optimized for minimum wear and maximum longevity.

It is preferred that the tachometer run at 0.5× crankshaft speed, the propeller governor drive run at 0.576× crankshaft speed, the vacuum pump gear run at 0.833× crankshaft speed, the magnetos be driven at crankshaft speed and the compound gear run at 0.5× crankshaft speed.

It is also preferred that there be approximately twelve (12) spur gears in all (13 counting the compound gear), and four spiral bevel gears, although the specific number of gears is not critical to the present invention so long as there are sufficient gears for the operation of all accessory devices.

The present invention also includes dual centrifugal water pumps 40*a* and 40*b* which, in the preferred embodiment, would deliver approximately ninety (90) US gals/min at 30 feet of head and which are reversible. The water pumps are mounted in a manner that does not permit the intermixing of coolant fluid and lubricating oil in the event of pump failure. By virtue of its high pressure delivery, the coolant system avoids the generation of cavitation bubbles that could cause premature engine failure.

The oil/water pump gears in turn drive a pair of oil pumps via either a hex or a spline drive on each water pump. One of the reversible oil pumps has four stages: three scavenge sections and one pump section that delivers approximately 14.8 gals/min. The other dry sump pump has five stages: one pressure stage and four scavenge stages. One stage scavenges the propeller speed reduction unit, another scavenges the accessory drive gearbox and the other two stages scavenge the valve covers. If supercharged both pumps would consist of five stages each.

The oil pumps can be switched by a pilot/operator via a valve which in the case of an engine oil pump failure permits the opposite pump to be employed to provide engine oil pressure. This would be considered a limp home mode. The oil pan 20 would preferably include three scavenge sections: two water crossovers and one oil crossover for piston-cooling oil. The valve springs are also cooled via spray jets which both cools them and greatly increases life expectancy.

One of the more innovative and important features of the oil delivery system of the present invention is that the system includes an air/oil centrifugal separator which is attached to an accessory drive pad. The centrifugal separator acts to spin the oil at an extremely high rate of speed to substantially eliminate air bubbles which form in the oil during the circulation of the oil through the engine, and the centrifuged oil is then sent back into the engine to continue cooling and lubricating the engine. By removing air from both the lubricating and cooling oil systems, the operating efficiency of both systems is enhanced.

It is contemplated that in the future a modular intake manifold would employ an after cooler for either supercharged or turbo charged versions and an open plenum when normally aspirated.

The propeller speed reduction unit 14 of the present invention is shown best in FIG. 1 as being mounted on the core power plant 12 interposed between the propeller and the core power plant 12 to translate the power produced by the engine to the propeller in an efficient and reliable manner.

The important features of the propeller speed reduction unit are listed herein in no particular order, but it is believed that each of the listed features adds to the overall performance and efficiency of the propeller speed reduction unit of the present invention.

The propeller speed reduction unit drives the propeller, via spur gear reduction gearing, so that the engine preferably rotates at 2.133× propeller speed. This is preferably done via a 30-tooth pinion/64-tooth gear. This results in the propeller being driven in the opposite direction to the rotation of the engine crankshaft. Also, it is contemplated that different gear ratios may be utilized to optimize efficiency, depending on the intended functionality of the engine of the present invention. The blown supercharged engine will run slower than the unblown non-supercharged.

A machined flywheel mates the damper as previously described to the crankshaft.

Oil is delivered to the gears of the propeller speed reduction unit via a spray bar as they come out of mesh, the oil spray serving to both cool and lubricate the propeller speed reduction unit.

Oil is also delivered to the propeller speed reduction unit via a passage into the hollow spline shaft. This oil feed serves to eliminate stress corrosion of the mating spline and propeller shafts.

Finally, the propeller shaft of the propeller speed reduction unit is hollow to permit the application of a constant-speed propeller.

It is also contemplated to use a combined damper/viscous drive which could employ a lockout clutch electrically activated to drive the supercharger. This would eliminate drive shock to the overdriven gear train as well as the supercharger when there are engine RPM changes in a short span of time. The lockout clutch would eliminate any oil heating from the viscous drive and would give near 100% efficiency and would disengage with rapid throttle movement. The damper would isolate engine harmonics from the blower drive blower while the lockout clutch is engaged.

Of course, it is to be understood that numerous modifications, additions, and substitutions may be made to the present invention which fall within the intended broad disclosure. For example, the specific design and nature of the damping units may be modified or changed to permit the engine to be used in other types of applications. It has been further contemplated to use the engine of the present invention in the land and marine environments as well. Also, the use of mechanical superchargers or exhaust driven turbo superchargers as single or multiple units is contemplated. Furthermore, it is also contemplated that the present invention could include mechanical magnetos which power the electronic ignition system, although an electronic system with multiple coils could be used. Also, the use of either mechanical or electrical fuel injection systems is contemplated, as either are known in the art. It also should be noted that the use of F.A.D.E.C. (Fully Authorized Digital Engine Control) is known in the art and its use with this invention is contemplated. Furthermore, the precise interconnections and design features disclosed previously may be modified, changed, included or excluded so long as the functionality of the engine of the present invention is not degraded or destroyed. Finally, the dimensions and construction materials used in the manufacturing of the present invention may be modified or changed so long as the functionality of the present invention is not degraded or destroyed, and such changes will not affect the scope of protection intended to be achieved by this disclosure.

There has therefore been shown and described an improved engine for aeronautical applications which accomplishes at least all of its intended objectives.

I claim:

1. An improved engine for aeronautical applications comprising:

a core engine block having a block valley and having a drive means rotatably mounted within said core engine block and motive means for rotating said drive means, said motive means including two cylinder banks in a V-type configuration;

a propeller speed reduction unit connected to said drive means for transferring power from said drive means to a propeller mounted on said propeller speed reduction unit;

an accessory drive gearbox connected to said drive means for transferring power from said drive means to at least one accessory device connected to said accessory drive gearbox;

said accessory drive gearbox including an accessory drive crank gear connected to said drive means and a drive gear intermeshing with said crank gear for translating rotation of said crank gear to at least one accessory drive gear intermeshed therewith; and at least two inter-module dampers, at least one of said inter-module dampers positioned between said core engine block and said accessory drive gearbox and at least one of said inter-module dampers positioned between said core engine block and said propeller speed reduction unit, each of said at least two inter-module dampers operative to dampen and isolate vibrations preventing destructive resonances from initiating.

2. The improved engine of claim 1 further comprising a "spider" device having a plurality of pipes connected in a oil distribution network, said "spider" being fitted to said block valley of said core engine block, said "spider" device operative to vent the block valley to the crankcase, prevent oil drain-back onto a reciprocating assembly within said core engine block, route the oil pressure feed to a front of a block oil gallery and provides oil scavenging of said block valley and contribute to further strengthening and stiffening of said core engine block.

3. The improved engine of claim 1 wherein said at least one of said inter-module dampers positioned between said core engine block and said accessory drive gearbox comprises a generally toroidal fluid-type harmonic vibration damper mounted between said crank gear and said drive means, said generally toroidal fluid-type harmonic vibration damper operative to isolate the vibrations of said motive means and said drive means and said accessory drive gearbox from each other permitting smoother rotation of gears within said accessory drive gearbox and thus reducing wear and tear on the gears.

4. The improved engine of claim 1 wherein said at least one of said inter-module dampers positioned between said core engine block and said propeller speed reduction unit comprise a series of high-impact, high-density urethane compound plates which are operative to absorb and diminish vibrations of said motive means and said drive means prior to reaching said propeller speed reduction unit.

5. The improved engine of claim 1 further comprising at least two coolant pumps connected in fluid transmission connection to said core engine block, said at least two coolant pumps operative to circulate coolant fluid within said core engine block for cooling thereof, said at least two coolant pumps connected in redundant fluid connection whereby individual cylinder banks are cooled by a specific one of said at least two coolant pumps and, in the event of failure of one of said at least two coolant pumps, the remaining pump via a system of bypass and check valves, together with cross-feed lines, ensures continued coolant liquid flow from the remaining pumps to core engine block.

6. An improved engine for aeronautical applications comprising:

a core engine block having a block valley and having a drive means rotatably mounted within said core engine block and motive means for rotating said drive means, said motive means including two cylinder banks in a V-type configuration and a plurality of cylinders mounted within said cylinder banks for producing power and rotating said drive means;

a propeller speed reduction unit connected to said drive means for transferring power from said drive means to a propeller mounted on said propeller speed reduction unit;

an accessory drive gearbox connected to said drive means for transferring power from said drive means to at least one accessory device connected to said accessory drive gearbox;

said accessory drive gearbox including an accessory drive crank gear connected to said drive means and a drive gear intermeshing with said crank gear for translating rotation of said crank gear to at least one accessory drive gear intermeshed therewith;

at least two inter-module dampers, at least one of said inter-module dampers positioned between said core engine block and said accessory drive gearbox and at least one of said inter-module dampers positioned between said core engine block and said propeller speed reduction unit, each of said at least two inter-module dampers operative to dampen and isolate vibrations preventing destructive resonances from initiating; and each of said plurality of cylinders mounting a forward and a rearward spark plug, said forward spark plug being sparked by a first independent ignition system and said rearward spark plug being sparked by a second independent ignition system, said first and second independent ignition systems operative to function free of each other in the event of failure of one of said first and second independent ignition systems such that said engine is capable of continued normal operation following the failure of one of said first and second independent ignition systems.

7. An improved engine for aeronautical applications comprising:

a core engine block having a block valley and having a drive means rotatably mounted within said core engine block and motive means for rotating said drive means, said motive means including two cylinder banks in a V-type configuration and a plurality of cylinders mounted within said cylinder banks for producing power and rotating said drive means;

a propeller speed reduction unit connected to said drive means for transferring power from said drive means to a propeller mounted on said propeller speed reduction unit;

an accessory drive gearbox connected to said drive means for transferring power from said drive means to at least one accessory device connected to said accessory drive gearbox;

said accessory drive gearbox including an accessory drive crank gear connected to said drive means and a drive gear intermeshing with said crank gear for translating rotation of said crank gear to at least one accessory drive gear intermeshed therewith;

at least two inter-module dampers, at least one of said inter-module dampers positioned between said core engine block and said accessory drive gearbox and at least one of said inter-module dampers positioned between said core engine block and said propeller speed reduction unit, each of said at least two inter-module dampers operative to dampen and isolate vibrations preventing destructive resonances from initiating; and an oil delivery system in oil transmission connection with said core engine block, said propeller speed reduction unit and said accessory drive gearbox operative to circulate oil for cooling and lubrication of said core engine block, said propeller speed reduction unit and said accessory drive gearbox, said oil delivery system including an air/oil centrifugal separator connected to and driven by said accessory drive gearbox, said air/oil centrifugal separator operative to spin oil therewithin at an extremely high rate of speed to substantially eliminate air bubbles which form in the oil during the circulation of the oil through said engine, thus removing air from said oil and substantially enhancing the cooling and lubrication efficiency of said oil delivery system.

* * * * *